US005078634A

United States Patent [19]

Yoshioka

[11] Patent Number: 5,078,634

[45] Date of Patent: Jan. 7, 1992

[54] METHOD FOR MANUFACTURING A VIBRATION SUPPRESSING ELECTROLUMINESCENT DEVICE

[75] Inventor: Kenji Yoshioka, Miyagi, Japan

[73] Assignee: Alps Electric Co., Ltd., Tokyo, Japan

[21] Appl. No.: 663,235

[22] Filed: Mar. 1, 1991

Related U.S. Application Data

[62] Division of Ser. No. 413,133, Sep. 27, 1989.

[30] Foreign Application Priority Data

Nov. 7, 1988 [JP] Japan ..... 63-144374

[51] Int. Cl.[5] ..... H05B 39/06

[52] U.S. Cl. ..... 445/25; 313/512

[58] Field of Search ..... 445/24, 25; 313/512

[56] References Cited

U.S. PATENT DOCUMENTS 3,461,522 8/1969 Vodicka ..... 445/24 X 3,497,750 2/1970 Knochel et al. ..... 313/512 X 4,617,195 10/1986 Mental ..... 313/506 X

*Primary Examiner*—Kenneth J. Ramsey

*Attorney, Agent, or Firm*—Guy W. Shoup; David W. Heid

[57] ABSTRACT

The present invention discloses an electroluminescent panel device in which a laminate having an electroluminescent layer held between an opposed electrode and a transparent electrode is sealed by a pair of protective sheets, wherein a metal composite film having a metal foil rigidly held by a resin film is used as the protective sheet on the side of the opposed electrode, first and second terminals are drawn from the transparent electrode and the opposed electrode, the first terminal and the metal foil held on the resin film being connected in conduction, and an AC drive electric field is applied to the first and second terminals to thereby suppress vibrations of the electroluminescent panel caused by application of the drive electric field.

3 Claims, 3 Drawing Sheets

METHOD FOR MANUFACTURING A VIBRATION SUPPRESSING ELECTROLUMINESCENT DEVICE

This application is a division of application Ser.No. 07/413,133, filed Sept. 27, 1989.

BACKGROUND OF THE INVENTION

1. Field of the Invention

The present invention relates to an electroluminescent panel device in which an AC drive electric field is applied to an electroluminescent layer to thereby emit light in said electroluminescent layer.

2. Prior Art

An electroluminescent panel of this kind is designed so that an electroluminescent layer comprising a flourescent material and a high dielectric material is held between electrode layers provided on opposite surfaces thereof, at least one of said electrode layers being formed as a transparent electrode, and an AC voltage is applied between these both electrodes to emit light in the electroluminescent layer.

The thus structured electroluminescent panels have been widely used as display elements for various machineries and devices, and back-light sources of displays.

In the above-described AC drive electroluminescent panel, high dielectric resins such as cyanoethyl cellulose or cyanoethylpulran, or high dielectric such as barium titanate are used as material for constituting an electroluminescent layer. Since such materials exhibit piezoelectric properties, the panel is vibrated by the AC electric field caused by application of a driving AC voltage to generate a vibration noise (buzzing).

This vibration is not only offensive to the ear but shortens the life of the electroluminescent panel and adversely influences on machineries and devices applied.

SUMMARY OF THE INVENTION

An object of the present invention is to settle the problems noted above with respect to prior art and provide an electroluminescent panel device which is simple in construction and which can prevent an occurrence of vibration even in the AC drive.

The aforesaid object is achieved by an arrangement wherein a metal composite film having a metal foil rigidly held by a resin film is used as a protective sheet on the side of the opposed electrodes, a first and a second terminals are drawn from the transparent electrode and the opposed electrodes, the first terminal and the protective sheet on the side of the opposed electrodes being connected by a first clincher connector, said second terminal being connected by a second clincher connector, and an AC drive electric field is applied to the first and second clincher connectors to thereby suppress vibrations of the electroluminescent panel caused by the application of said drive electric field.

The vibration of the electroluminescent panel is offset by a vibration in a portion between the opposed electrodes and the metal foil having a phase difference of 180° therebetween to suppress the vibration of the whole electroluminescent panel device.

DETAILED DESCRIPTION OF THE PREFERRED EMBODIMENTS

Figure 1:
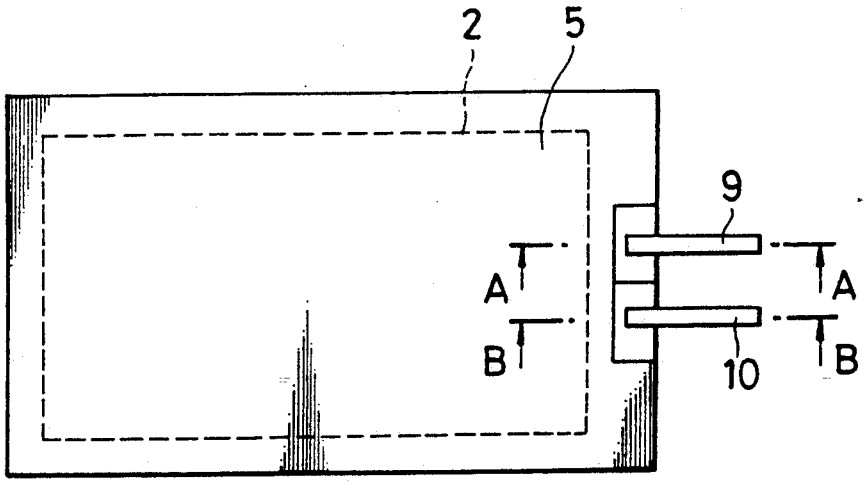
FIG. 1 is a plan view of an electroluminescent panel device according to the present invention.

One embodiment of the present invention will be described with reference to the drawings.

Referring to these Figures, a light emitting layer 4 comprising a fluorescent material and a dielectric material is interposed between a transparent electrode 2 formed on the lower surface shown of a transparent sheet 1 and an opposed electrode 3 formed from a metal foil such as aluminum or a printed silver resin layer to constitute a laminate which is sealed by a pair of protective sheets 5 and 6. When such an electroluminescent panel device is used in a state wherein water is present in the light emitting layer 4, the fluorescent material is rapidly cracked to deteriorate a brightness, greatly lowering the service life thereof, but the air-tightness thereof is kept by the pair of protective sheets 5 and 6. As the protective sheet 5 on the side of the transparent electrode 2, resin films such as ethylene dichloride trifluoride or polyethylene which is transparent and excellent in moisture proof, and as the protective sheet 6 on the side of the opposed electrode 3, a metal composite film having an extremely high moisture proof in which a metal foil 8 such as aluminum is laminated on resin films 7, 7 such as polyethylene terephtalate is used. The peripheral edges of the protective sheets 5 and 6 are closely bonded together by a heat seal using a hot melt agent.

Figure 2:
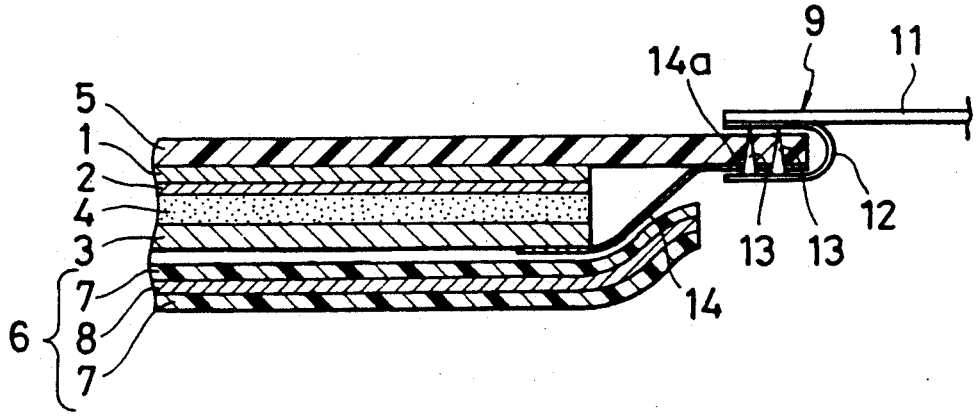
FIG. 2 is a sectional view taken on line A—A of FIG. 1.
Figure 3:
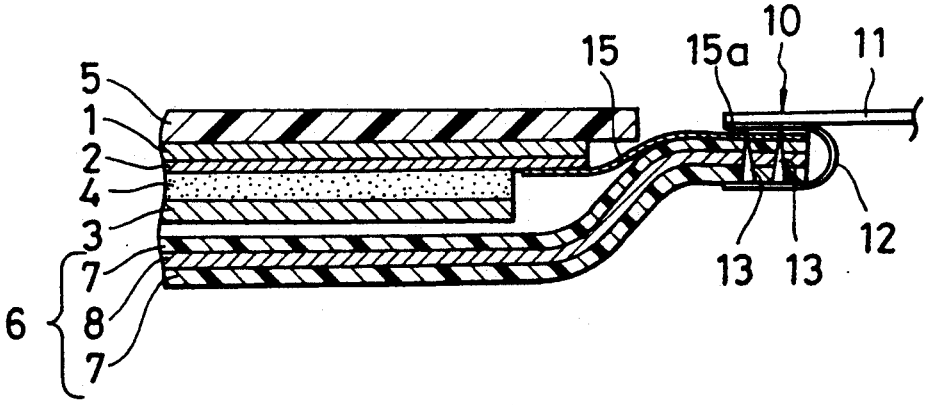
FIG. 3 is a sectional view taken on line B—B of FIG. 1.

Clincher connectors 9 and 10 as feed terminals are provided, as shown in FIG. 1, on the end of the transparent electrode 2 or the like. These clincher connectors 9 and 10 are well known, in which a U-shaped spring-like clip 12 is provided on one end of a conductor 11, and two conductive projections 13 and 13 are provided on the inner surface of the clip 12. One connector 9 connects the conductor 11 and the opposed electrode 3. That is, a lead terminal 14 in the form of a metal foil is drawn from the lower end of the opposed electrode 3, and an end **14*a* of the lead terminal 14 extends to the lower surface of the protective sheet 5, as shown in FIG. 2. The end 14*a* of the lead terminal 14 and the protective sheet 5 in the laminated state are inserted into the clip 12 of the clincher connector 9, and the clip 12 is pressed from top and bottom whereby the conductive projections 13 and 13 are stuck into the lead terminal 14 and the protective sheet 5 so that the conductive projection 13 and the lead terminal 14 are connected. The other clincher connector 10 connects the conductor 11, the transparent electrode 2 and the metal foil 8. That is, as shown in FIG. 3, the light emitting layer 4 and the opposed electrode 3 are cut so that the lower end of the transparent electrode 2 is exposed. The lead terminal in the form of a metal foil is drawn from the lower end and an end of the lead terminal 15 extends to the upper surface of the end of the protective sheet 6. The end 15*a* of the lead terminal 15 and the protective sheet 6 in the laminated state are inserted into the clip 12 of the clincher connector 10 and the clip 12 is pressed from top and bottom whereby the conductive projections 13 and 13 are stuck into the lead terminal 15 and the protective sheet 6 so that the conductive projections 13, 13, the metal foil 8 and the lead terminal 15 are connected. When voltage is applied between both the electrodes 2 and 3 from outside through the conductors 11 and 11, the light emitting layer 4** emits light.

Figure 5:
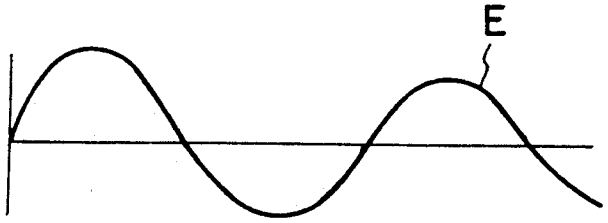
FIG. 5 is a graph showing vibration waveforms.
Figure 6:
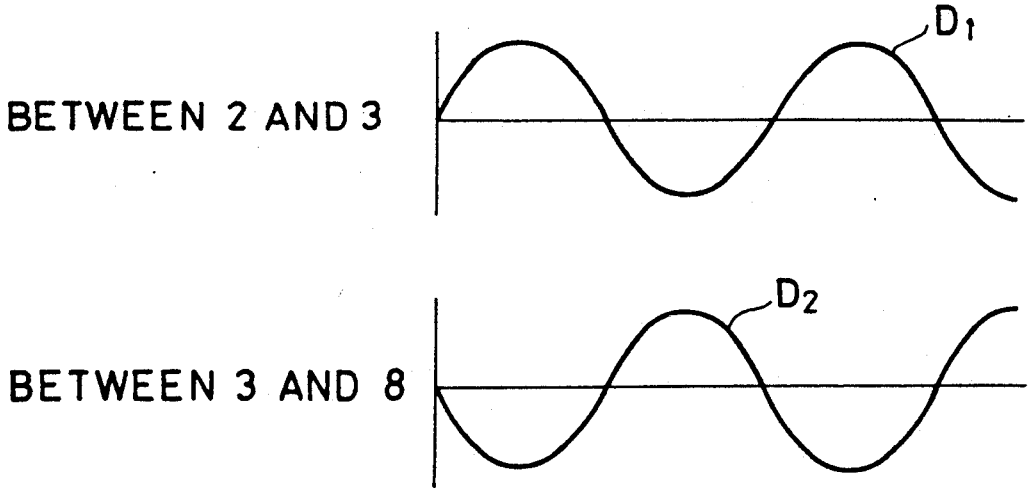
FIG. 6 is a graph showing AC waveforms to be supplied.

In the electroluminescent panel device, an AC voltage E shown in FIG. 5 is applied between the transparent electrode 2 and the opposed electrode 3 through the clincher connectors 9 and 10 whereby an AC electric field is applied to the light emitting layer 4. Thereby, the light emitting layer 4 forms just like a kind of piezoelectric element to generate a vibration $D_1$ corresponding to the frequency of the applied AC electric field (see FIG. 5). On the other hand, since the metal foil 8 is arranged in symmetry with the transparent electrode 2 about the opposed electrode 3, when the AC voltage E is applied between the opposed electrode 3 and the metal electrode 8 through the clincher connectors 9 and 10, the opposed electrode 3 and the metal foil 8 are attracted and non-attracted each other to produce a vibration $D_2$ deviated in phase by 180° from the vibration waveform of the light emitting layer 4. As the result, the vibration of the light emitting layer 4 is offset by the vibration between the opposed electrode 3 and the metal foil 8 to suppress the vibration of the whole electroluminescent panel device.

Figure 4:
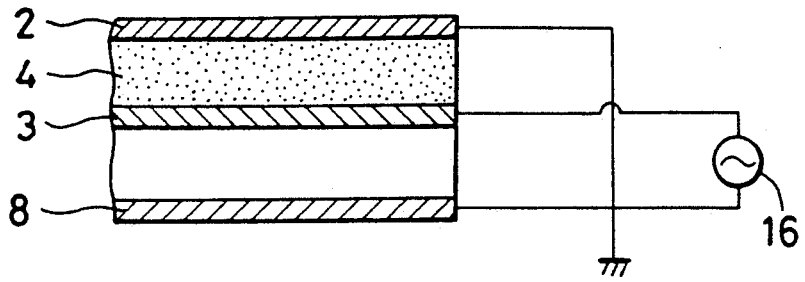
FIG. 4 is a block diagram showing a schematic construction.

FIG. 4 is a block diagram showing a schemtic circuit of the above described embodiment. 16 is a drive power supply E.

It is to be noted that the light emitting layer 4 in the above-described embodiment may be formed as a layer separately from the dielectric layer and the fluorescent layer, or the fluorescent material may be mixed and formed using dielectric as binder.

As described above, according to the present invention, since the vibration of the light emitting layer is offset by the vibration between the opposed electrode and the metal foil having a vibration phase deviated by 180°from the light emitting layer, the vibration as the whole apparatus is not generated to prevent noises during light emission. In addition, since the metal foil constituting a metal composite film having a high moisture proof can be used as a metal sheet, a metal sheet need not be prepared separately thus reducing the manufacturing cost. Moreover, since the opposed electrode, the transparent electrode and the metal foil are connected to the drive power supply by the clincher connectors, the strength of terminal is high as compared with conventional pin ends, the connecting work is simple and the connection of connectors can be made.

What is claimed is:

1. A method for manufacturing a vibration suppressing electroluminescent device comprising:

preparing a laminate structure having a luminescent layer interposed between a transparent electrode and an opposing electrode;

preparing a light-transmissive moisture-proof protective sheet and a metal composite film having a metal foil disposed between a pair of resin films;

sealing said laminate structure between said light-transmissive protective sheet and said metal composite film;

electrically connecting said metal foil of said sealed metal composite film to said sealed transparent electrode; and connecting terminals to said sealed transparent electrode and said sealed opposing electrode;

wherein a first vibration of the light emitting layer caused by an AC current applied to said transparent electrode and said opposed electrode is suppressed by a second vibration caused by said AC current being applied to said opposed electrode and said metal foil, said second vibration having a phase difference of 180° from said first vibration.

2. A method for producing a vibration suppressing electroluminescent device of claim 1 wherein the step of sealing said laminate structure between said light-transmissive protective sheet and said metal composite film comprises heat sealing using a hot melt agent.

3. A method for manufacturing a vibration suppressing electroluminescent device of claim 1 wherein the step of electrically connecting said metal foil to said transparent electrode comprises connecting a clincher connector having at least one conductive projection such that said conductive projection passes through a portion of said metal foil and contacts a lead terminal connected to said transparent electrode.

* * * * *